United States Patent [19]

Degueldre et al.

[11] 4,125,450

[45] Nov. 14, 1978

[54] PREVIOUS DIAPHRAGMS FOR CELLS FOR THE ELECTROLYSIS OF AQUEOUS SOLUTIONS OF ALKALI METAL HALIDES

[75] Inventors: Louis Degueldre; Edgard Nicolas, both of Brussels, Belgium

[73] Assignee: Solvay & Cie, Belgium

[21] Appl. No.: 783,822

[22] Filed: Apr. 1, 1977

[30] Foreign Application Priority Data

Apr. 26, 1976 [LU] Luxembourg ..... 74835

[51] Int. Cl.[2] ..... C25B 13/06; C25B 13/08; B01D 39/00

[52] U.S. Cl. ..... 204/296; 204/95; 210/509; 429/247

[58] Field of Search ..... 204/295, 296; 210/509

[56] References Cited

U.S. PATENT DOCUMENTS

| | | | |
|---|---|---|---|
| 2,978,401 | 4/1961 | Hoch et al. | 204/296 |
| 3,013,100 | 12/1961 | Mendelsohn et al. | 204/296 X |
| 3,265,536 | 8/1966 | Miller et al. | 204/296 X |
| 3,583,891 | 6/1971 | Hacker et al. | 162/155 |
| 3,723,264 | 3/1973 | Leduc et al. | 204/80 |
| 3,853,720 | 12/1974 | Korach et al. | 204/98 |
| 3,980,613 | 9/1976 | Bachot et al. | 264/45.3 |
| 4,014,775 | 3/1977 | Kircher et al. | 204/252 |
| 4,031,041 | 6/1977 | Bouy et al. | 260/2.5 M |

*Primary Examiner*—F.C. Edmundson

*Attorney, Agent, or Firm*—Robert E. Burns; Emmanuel J. Lobato; Bruce L. Adams

[57] ABSTRACT

Pervious diaphragms for cells for the electrolysis of aqueous solutions of alkali metal halides and the method of manufacture thereof are disclosed; the pervious diaphragms comprise inorganic fibers and a polymer which is selected from polyelectrolytes insoluble in aqueous solutions of alkali metal halides.

25 Claims, No Drawings

PREVIOUS DIAPHRAGMS FOR CELLS FOR THE ELECTROLYSIS OF AQUEOUS SOLUTIONS OF ALKALI METAL HALIDES

BACKGROUND OF THE INVENTION

The present invention relates to pervious diaphragms based on inorganic fibers such as asbestos intended for cells for the electrolysis of aqueous solutions of alkali metal halides such as sodium chloride or potassium chloride. More particularly it relates to diaphragms of stabilized thickness, that is to say diaphragms whose thickness remains substantially constant during their whole working life, directly deposited on foraminate cathodes. The invention also relates to a method for the manufacture of such diaphragms and to electrolytic cells equipped with such diaphragms.

To manufacture an asbestos diaphragm directly on the foraminate cathode of an electrolytic cell, it is known, from U.S. Pat. No. 1,865,152 in the name of K E STUART, of June, 28, 1932, to disperse asbestos fibers in an aqueous solution, to immerse the cathode in the suspension of asbestos thereby obtained, then to suck the suspension through the foraminate cathode. During suction of the suspension through the foraminate cathode, the asbestos fibers are retained on the cathode where they progressively build-up the diaphragm.

In the known method, the aqueous solution may be a solution of sodium chloride or potassium chloride or an alkaline solution obtained from a diaphragm cell in which a sodium chloride or potassium chloride brine is being electrolyzed.

The advantage of this known method resides in its simplicity and in the capability of applying asbestos diaphragms with precision onto cathodes of complex cross-section. It is generally used in the case of cells with interleaved vertical electrodes, of the type described in Belgian Pat. Nos. 780,912 and 806,280 in the name of the present applicant, applied for resepctively on 20.3.72 and 19.10.73.

The diaphragms obtained by this known method have however the disadvantage of suffering changes in thickness, often large changes, during the course of electrolysis. Thus, during the first weeks of use, these diaphragms generally begin to swell, with the detrimental result a considerable increase of the ohmic resistance in the diaphragm. Furthermore, this swelling of the diaphragm interferes with the release of the chlorine produced at the anodes. In order to avoid accelerated deterioration of the diaphragm by erosion owing to turbulent release of chlorine, it is necessary to construct the cells so that the distance between the anodes and the cathodes is large and generally greater than 10 mm, even as much as 15 mm. All other things being equal, this entails the two-fold disadvantage of increasing the space occupied by the cells and reducing the energy yield of the electrolysis.

To avoid these disadvantages of diaphragms obtained by this known method, there has been proposed, in Belgian Pat. No. 809,822 of Jan. 16, 1974, of DIAMOND SHAMROCK CORPORATION, a method wherein an aqueous suspension of asbestos fibers and fibers or particles of a thermoplastic polymer is formed, the suspension is sucked through the foraminate cathode to deposit on it a diaphragm formed of a substantially homogeneous mixture of the asbestos fibres and the polymer, and the diaphragm is heated at high temperature, for example above 300° C., to melt the polymer and allow it to bind together the asbestos fibers.

Although this known method allows the dimensional stability of asbestos diaphragms to be improved, it still has the disadvantage that it is expensive because it involves the use of polymers that are difficult to manufacture. Moreover, the method is critical and risky to carry out. It is specially difficult to ensure a homogeneous dispersion of the polymer among the asbestos fibers. Also, the fusion of the polymer necessitates heating to very high temperatures, which not only considerably burdens the cost of manufacturing the diaphragms but often causes distortion of the cathode.

To improve the dimensional stability of asbestos diaphragms it has also been proposed, in German Pat. No. 1,696,259 of Mar. 18, 1967, of SIEMENS AG, to treat the asbestos with a solution of alkali metal hydroxide and afterwards to heat the diaphragm formed on the cathode, between 300° and 700° C. This known method allows a reduction in the tendency of asbestos diaphragms to swell during use in electrolytic cells. However, it has the same disadvantage of requiring a thermal treatment which is expensive and is likely to damage the cathode.

In order to improve the firmness and the mechanical properties of diaphragms not directly formed on the cathode but made from sheets of asbestos fibers, it has been proposed, in U.S. Pat. No. 3,694,281 of Apr. 9, 1969, in the name of J A LEDUC, to impregnate the asbestos sheets with a liquid medium containing a polymer, then to heat the impregnated sheets at high temperature, so as to melt the polymer.

This known method has the disadvantage of requiring a long and expensive thermal treatment. It has the further and important disadvantage of affecting the permeability and the hydrophilic nature of the diaphragms, the molten polymer having a tendency to block the pores formed between the fibers of asbestos.

SUMMARY OF THE INVENTION

The applicant has now found that the stability of the thickness of diaphragms based on inorganic fibres can be largely ensured while avoiding the disadvantages of the aforesaid known methods.

The invention therefore provides pervious diaphragms for cells for the electrolysis of aqueous solutions of alkali metal halides comprising inorganic fibers and a polymer which is selected from polyelectrolytes insoluble in aqueous solutions of alkali metal halides.

DESCRIPTION OF THE INVENTION

By "polyelectrolytes" the applicant means all polymeric substances which comprise monomer units containing ionizable groups, following the generally accepted definition (Encyclopedia of Polymer Science and Technology, vol, 10, p. 781, 1969, John Wiley and Sons).

In the context of the present invention, the applicant prefers to use as polyelectrolytes, the polyacids of weakly acid character, which are well known in the art (Op. cit., p. 781–784). When they are dissociated, these polyacids give rise to polymeric anions (polyanions) and to elementary cations, for example protons or monovalent cations derived from alkali metals. The polyacids that are very weakly dissociated in pure water, such as the polyvinyl alcohols and the polyvinylpyrrolidones, also belong to this class, although they are sometimes considered as being non-ionic polymers. In fact these polyacids are dissociated in strongly polar liquid environments.

By polyacids of weakly acid character the applicant means polyacid polyelectrolytes that have a pH, measured on a 0.01N solution in pure water, greater than 4 and preferably greater than 6 (Op. cit., p.787 and 788).

The polyelectrolytes that can be used in the context of the present invention may be insoluble in aqueous solutions of alkali metal halides so as not to be removed from the diaphragms when these are in use. It is therefore advisable that the polyelectrolytes employed be insoluble under the conditions of operation of the cells where the diaphragms are used (temperature, concentration of the electrolyte in respect of alkali metal halide and products of electrolysis among others). It is easy to comply with this condition, because it is well known that the addition of non-polymeric electrolytes such as the alkali metal halides in relatively small amounts to aqueous solutions, even diluted, of polyelectrolytes causes precipitation of the latter (Op. cit., p.827–830). Thus the addition of 210g/liter of sodium chloride to a 5% aqueous solution of polyvinyl alcohol having a degree of hydrolysis equal to 99 moles % and a degree of polymerization between 1700 and 1800 is sufficient to cause precipitation of polyvinyl alcohol. Since aqueous solutions of alkali metal halides submitted to electrolysis are in general as concentrated as possible, it is not difficult to find a polyelectrolyte that is insoluble in the electrolysis medium.

In general, polyelectrolytes that have a solubility in aqueous solutions containing 250g/liter of sodium chloride, measured at 20° C., of less than 1% are suitable.

The polyacids of weakly acid character well suited for use in the context of the present invention are in general polymeric substances (of molecular weight greater than 1000) derived from polymers containing at least one hydroxyl group to 10 carbon atoms and preferably at least one hydroxyl group to 5 carbon atoms. They may be used in the form of acids or in the form of alkali metal salts.

By way of examples of these polyacids, there may be mentioned polymers of acrylic acid and of methacrylic acid, copolymers of maleic acid, carboxylic derivatives of cellulosic ethers, sulphonated and phosphonated polymers, polymers of vinyl esters partially or completely hydrolyzed, polyalphahydroxyacrylic acids and their alkali metal salts.

Polyacids very specially preferred by the applicant are the polyvinyl alcohols which are products of hydrolysis of polymers containing vinyl esters as monomer units such as the polyvinyl acetates. Among these, the applicant prefers to use polyvinyl alcohols derived from homopolymers of vinyl esters, and more particularly from vinyl acetate as well as those having a degree of hydrolysis greater than 80 moles % and a degree of polymerization greater than 500. The best results are obtained with polyvinyl alcohols that have a degree of hydrolysis between 85 and 95 moles % and a degree of polymerization between 1500 and 2500.

Another class of polyacids very specially preferred by the applicant is the class of polymers derived from alpha-hydroxyacrylic acids. These polymers contain in their molecule monomeric units of formula:

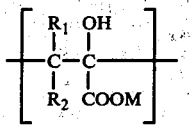

where $R_1$ and $R_2$ represent hydrogen or an alkyl group containing 1–3 carbon atoms which may be substituted by a hydroxyl group or a halogen atom, $R_1$ and $R_2$ being identical or different, and where M represents hydrogen, an alkali metal atom or an ammonium group.

Preferably, M represents an atom of sodium or potassium and $R_1$ and $R_2$ represent hydrogen or an unsubstituted methyl group. The best results are obtained when M represents a sodium atom and $R_1$ and $R_2$ represent hydrogen.

Also, the applicant prefers to use polymers containing 50 molar % of monomer units such as those defined above. The best results are obtained with polymers containing only such units.

The applicant also prefers to use polymers such as defined above in which the degree of polymerization is greater than 100.

Diaphragms according to the invention also contain inorganic fibers interlaced so as to form a structure analogous to that of paper. For making the diaphragms there may be used any inorganic fiber suitable for this purpose, and in particular the fibers of asbestos that are in current use for the manufacture of pervious diaphragms. The applicant prefers more particularly to use fibers of chrysotile asbestos.

The amount of polyelectrolyte employed is in general more than 10g per kg of inorganic fibers. It is preferably greater than 40g per kg. To achieve good results, it is generally unnecessary to employ more than 500g of polyelectrolyte per kg of inorganic fibers.

It will be understood that, besides inorganic fibers and polyelectrolytes, the diaphragms according to the invention may contain other conventional ingredients of pervious diaphragms, such as particles of fluorinated polymers, inorganic particles, organic fibers, etc.

The present invention also includes a method for the manufacture of pervious diaphragms such as those described above.

Although the polyelectrolyte can be incorporated into the diaphragm in any form whatever, the applicant nevertheless prefers to apply it for the manufacture of the diaphragm in the form of a solution. For this purpose any type of solvent may be used, for example alcohols such as methanol and ethanol, acetone and dimethylformamide. However, for reasons of availability, the applicant prefers to use water alone, which dissolves almost all polyelectrolytes. The concentration of the polyelectrolyte in the solution may vary widely and is chosen in relation to the amount of polyelectrolyte that it is desired to incorporate into the diaphragm. The temperature of the solution may also vary widely and is chosen with regard to the solubility of the polyelectrolyte in the solvent; in general the temperature is between 20° and 100° C.

The method according to the invention lends itself equally well to the manufacture of pervious diaphragms starting from prefabricated coherent sheets made of inorganic fibers, and to diaphragms made directly on a rigid foraminate support (for example the foraminate cathode of a diaphragm cell), starting from a suspension of asbestos fibers, using the technique described in the aforesaid U.S. Pat. No. 1,865,152 of KE STUART or in German patent application No. 2,134,126 of NIPPON SODA CO LTD, of July 8, 1971.

Thus according to a first embodiment of the method according to the invention, a flat coherent sheet of inorganic fibers is made, for example by the methods used in papermaking. Then this sheet is impregnated with a solution of polyelectrolyte, for example by immersion or by spraying. Finally, the impregnated sheet may be dewatered, for example by calendering, and/or dried.

According to another embodiment, a coherent sheet of inorganic fibers is made on a foraminate support by sucking through the support a suspension of inorganic fibers in a liquid medium such as a relatively viscous aqueous solution. Thereby there is obtained a sheet that follows the contours of the foraminate support. The sheet is afterwards impregnated with a solution of polyelectrolyte as in the preceding embodiment and may be dried. In this embodiment, the foraminate support may remain in place at the end and is preferably the cathode itself.

The applicant prefers, however, to use another embodiment, wherein the inorganic fibers are formed into a suspension in the solution of polyelectrolyte. This suspension is sucked through the foraminate support on which the diaphragm is thus formed directly. In this embodiment, the foraminate support may be a temporary one. This may be for example an endless guaze from which the diaphragm is removed; the diaphragm is then flat and may be dewatered and/or dried. The applicant prefers, however, to use a foraminate support which remains in place at the end and which is preferably constituted by the cathode itself.

In this preferred embodiment, there may be dissolved a thickening agent that does not affect the solubility of the polyelectrolyte so as to increase the viscosity of the suspension and consequently its stability. In general it is advantageous, in order to obtain a diaphragm having a good permeability and good electrical properties, to keep the absolute viscosity of the suspension between substantially 1 and 30 centipoises, preferably 2 and 10 centipoises, at 20° C.

According to an advantageous feature of the invention, the thickening action may be provided by the polyelectrolyte itself. This is the case, for example, when there is used polyacrylic acid, a polymer derived from alpha-hydroxyacrylic acid or polyvinyl alcohol, which are available in various qualities differentiated from each other by the degree of polymerization.

In this same preferred embodiment of the method according to the invention, in order to improve the permeability of the diaphragm, a phosphate of ammonium or of an alkali metal may be dissolved in the suspension, so as to help towards obtaining as homogeneous dispersion provided that the solubility of the polyelectrolyte is not effected. However, diaphragms with poorer electrical properties are then obtained.

In the method according to the invention, the diaphragm may be put into the cell immediately after being impregnated with the solution of polymer.

It is, however, preferable, in order to improve the mechanical and electrical properties of the diaphragm, to dry it at least partially before putting it into the cell. The drying of the diaphragm is carried out at a temperature below the melting point of the polyelectrolyte, for convenience and so as to avoid damaging the diaphragm. It may for example be carried out in a current of air at ambient temperature or by heating the diaphragm, preferably to a temperature lower than the boiling point of the solvent. In general, the drying is carried out between 20° and 150° C. and preferably between 40° and 100° C.

According to another particular embodiment of the method according to the invention, the diaphragm impregnated with the solution of polyelectrolyte is treated with a liquor in which the polyelectrolyte is insoluble so as to precipitate the polyelectrolyte, for example by immersion, spraying or washing. As a modification, the diaphragm may then be dried under the conditions described above to remove the liquor from the diaphragm. This particular embodiment of the invention may for example be applied to the manufacture of diaphragms that are to be put into storage before use in electrolytic cells. As the liquor in which the polyelectrolyte is insoluble there may be used the electrolyte which is to be treated in the cell for which the diaphragm is intended, for example an aqueous solution of sodium chloride or a caustic liquor.

The diaphragms according to the invention may be used in any type of diaphragm cells where there is percolation of the solution of electrolyte through the diaphragm, such as vertical cells with an alternating sequence of anodes and cathodes separated by diaphragms and horizontal cells. They are particularly well suited to the electrolysis of aqueous solutions of sodium chloride and of potassium chloride.

In comparison with the known diaphragms described in USP 1865152, the diaphragms according to the invention have a considerably improved stability of thickness in service. They also allow a considerable reduction to be made in the anode-cathode distance of diaphragm cells. They have a stability of thickness comparable to that of diaphragms obtained by the aforesaid improved methods described in Belgian Pat. No. 809,822, German Pat. No. 1,696,259 and U.S. Pat. No. 3,694,281. They possess the advantage over these of having a lower electrical resistivity and of allowing, all other things being equal, the use of lower electrolyzing voltages.

Moreover, the diaphragms according to the invention generally have a higher permeability than the asbestos diaphragms obtained by the known methods. From this stems for the invention the supplementary advantage of permitting higher current densities in the electrolytic cells and, consequently, an increase in the productivity of cells, without increasing too greatly the concentration of alkali metal hydroxide in the catholyte.

The various examples of use which follow will illustrate the invention, without however limiting its scope.

In each of these examples, an asbestos diaphragm was made directly on a cathode consisting of a disc of 120 $cm^2$ surface area made of a steel lattice. The cathode, covered with the diaphragm, was then set up vertically in a laboratory-type electrolytic cell, facing an anode made up of a succession of vertical titanium vanes carrying an electrocatalytic coating consisting of a mixture of ruthenium oxide and titanium dioxide. The distance between the cathode and the vanes of the anode was adjusted to 5 mm (except in Example 2, 3 and 4, where the distance was made respectively 10, 6 and 4 mm). In the cell made up in this manner a brine saturated with sodium chloride was electrolyzed at 85° C., at an anodic current density of $2kA/m^2$ and a hydrostatic pressure on the diaphragm equal to a 30 cm head of electrolyte.

For each diaphragm there were recorded the voltage across the cell terminals and the permeability of the diaphragm after several days of electrolysis, the said permeability being defined by the relationship:

$$K = Q/S.H,$$

where $Q$ is the rate of flow of electrolyte through the diaphragm (in $cm^3/h$), $S$ is the useful cross-section of the diaphragm (in $cm^2$), and $H$ is the hydrostatic pressure of the electrolyte on the diaphragm, expressed as head of electrolyte in cm (30 cm in the examples).

FIRST SERIES OF TESTS

These tests relate to diaphragms by the prior art methods described above.

EXAMPLE 1

17.5g of chrysotile asbestos fibers were dispersed in 0.9 liter of an aqueous solution of sodium chloride and sodium hydroxide containing about 170g/liter of NaCl and 120g/liter of NaOH coming from a diaphragm cell in which a sodium chloride brine was being electrolyzed. The suspension thus obtained was then filtered through the cathode lattice of the laboratory cell, by applying suction corresponding to 200 mm of mercury. The recovered filtrate was filtered a second time through the cathode lattice covered by the diaphragm, under a suction of 200 mm of mercury. The diaphragm was then dried at ambient temperature, applying beneath the cathode lattice successively a suction of 200 mm of mercury for 15 minutes than a suction of 400 mm of mercury for 30 minutes. The cathode furnished with the diaphragm was then set up in the laboratory cell, where an electrolysis test was carried out under the conditions stated above. After 20 days' electrolysis a voltage of 3.56V was recorded at the cell terminals and the permeability of the diaphragm was measured as $K = 0.118h^{-1}$.

EXAMPLE 2

The test of Example 1 was repeated, but with the distance separating the anode from the cathode adjusted this time to 10 mm. After 20 days' electrolysis a voltage of 3.59V was recorded at the cell terminals and the diaphragm showed a permeability $K = 0.105h^{-1}$.

EXAMPLE 3

17.5g of chrysotile asbestos fibers and particulate polytetrafluoroethylene (about 20 micron diameter) were dispersed in 0.9 liter of an aqueous solution of sodium chloride and sodium hydroxide coming from a diaphragm cell in which a sodium chloride brine was being electrolyzed. The polytetrafluoroethylene content of the suspension was fixed so that it represented about 8% of the total weight of asbestos and polytetrafluoroethylene. Starting with this previously homogenized suspension, a diaphragm was formed on the cathode, using the procedure of Example 1.

The cathode furnished with the diaphragm was then heated successively t 90° C. for 1 hour then at 240° C. for 1 hour. After cooling, the cathode with the diaphragm was set up in the cell, the distance between the anode and the cathode being adjusted to 6 mm. At the end of an electrolysis test of 17 day a voltage of 3.20 V was recorded at the cell terminals and the permeability of the diaphragm had risen to $0.065\ h^{-1}$.

EXAMPLE 4

17.5g of chrysotile asbestos fibers and particulate polytetrafluoroethylene (having a particle diameter of about 20 micron) were dispersed in 0.9 liter of a sodium chloride brine. The polytetrafluoroethylene content of the suspension was fixed so as to correspond to 10% of the total weight of asbestos and polytetrafluoroethylene. Starting with this previously homogenized suspension, a diaphragm was formed on the cathode using the procedure of Example 1. The cathode furnished with the diaphragm was then heated, successively at 90° C. for 16 hours then at 280° C. for 1 hour. After cooling, the cathode with its diaphragm was set up in the cell with a distance of 4 mm between the anode and the cathode. At the end of an electrolysis test of 20 days a voltage of 3.28V was recorded at the cell terminals and the diaphragm showed a permeability of $0.101h^{-1}$.

EXAMPLE 5

A diaphragm of chrysotile asbestos was formed on the foraminate cathode of the cell using the procedure described in Example 1. The cathode furnished with the diaphragm was then heated successively at 90° C. for 1 hour then at 240° C. for 1 hour. After cooling, the cathode furnished with its diaphragm was set up in the cell with a distance of 5 mm between the anode and the cathode. After 20 days' electrolysis, there were recorded a voltage of 3.18V at the cell terminals and a permeability of the diaphragm $K = 0.099h^{-1}$. After 60 days' electrolysis the voltage had risen to 3.21V and the and the permeability had fallen to $0.089h^{-1}$.

EXAMPLE 6

The trial of Example 5 was repeated with, however, the thermal treatment of the diaphragm modified so that it was heated successively at 90° C. for 16 hours, then at 240° C. for 1 hour. After an electrolysis test of 20 days, there were recorded a voltage of 3.222V at the cell terminals and, for the diaphragm, a permeability $K = 0.108h^{-1}$. At the end of 50 days' electrolysis the voltage had increased to 3.33V and the permeability had fallen to $0.098h^{-1}$.

The result of the six tests that have been described, carried out in accordance with the prior art methods, are recorded in Table 1.

TABLE 1

| Test No. | Initial Suspension | Thermal treatment | Electrolysis: Anode-cathode distance (mm) | Duration days | Voltage (V) | Permeability $K(h^{-1})$ |
|---|---|---|---|---|---|---|
| 1 | Chrysotile in solution NaCl + NaOH | none | 5 | 20 | 3.56 | 0.118 |
| 2 | idem | none | 10 | 20 | 3.59 | 0.105 |
| 3 | Chrysotile + 8% PTFE in solution NaCl | 1 hr at 90° C + 1 hr at 24° C | | | | |

TABLE 1-continued

| Test No. | Initial Suspension | Thermal treatment | Electrolysis: Anode-cathode distance (mm) | Duration days | Voltage (V) | Permeability $K(h^{-1})$ |
|---|---|---|---|---|---|---|
| | + NaOH | | 6 | 17 | 3.20 | 0.065 |
| 4 | Chrysotile + 10% PTFE in solution NaCl + NaOH | 16 hrs at 90° C + 1 hr at 280° C | 4 | 20 | 3.28 | 0.101 |
| 5 | Chrysotile in solution NaCl + NaOH | 1 hr at 90° C + 1hr at 240° C | 5 | 20 | 3.18 | 0.099 |
| | | | | 60 | 3.21 | 0.089 |
| 6 | idem | 16 hrs at 90° C + 1 hr at 240° C | 5 | 20 | 3.22 | 0.108 |
| | | | | 50 | 3.33 | 0.098 |

SECOND SERIES OF TESTS

These tests relate to asbestos diaphragms made by the method according to the invention.

EXAMPLE 7

A diaphragm of chrysotile asbestos was formed on the foraminate cathode of the cell, using the method described in Example 1. The diaphragm was then treated on the cathode with 0.5 liter of a solution of polyvinyl alcohol in water of concentration 40g/liter, the polyvinyl alcohol being that sold under the trade mark POLYVIOL W25/140 (WACKER-CHEMIE GmbH), and the diaphragm was then dried at 90° C. for 16 hours. The cathode with the diaphragm was then set up in the cell, the anode-cathode distance being adjusted to 5 mm. In the cell, the diaphragm was treated with a brine saturated with sodium chloride, while proceeding to electrolyze the brine under the conditions stated above. At the end of a period of 20 days' electrolysis the electrolyzing voltage measured at the cell terminals was 3.18V and the permeability of the diaphragm has risen $0.114h^{-1}$.

EXAMPLE 8

Polyvinyl alcohol sold under the trade mark ELVANOL 52/22 (E I du Pont de NEMOURS & Co) and sodium metaphosphate were dissolved in water so as to produce an aqueous solution containing 12g of alcohol and 2g of phosphate per liter, to obtain an absolute viscosity of about 2.5 centipoises at 20° C. 17.5g of chrysotile asbestos were then dispersed in 0.9 liter of the solution. From the suspension thus prepared an asbestos diaphragm was formed on the cathode, using the procedure described in Example 1, then the cathode and the diaphragm were set up in the electrolytic cell with a distance of 5 mm separating the anode from the cathode and the electrolysis of the sodium chloride brine was begun. At the end of a 10 day period of electrolysis a voltage of 3.15V was recorded at the cell terminals and the permeability of the diaphragm proved to be $K = 0.127h^{-1}$. After 40 days the voltage was found to be 3.13V and the permeability of the diaphragm $0.178h^{-1}$.

EXAMPLE 9

The test of Example 8 was repeated, but this time using an aqueous solution containing 12g of alcohol per liter and no phosphate for forming the diaphragm on the cathode. At the end of the test (20 days), a voltage of 3.15V was recorded at the cell terminals and the permeability of the diaphragm was found to be $0.139h^{-1}$.

EXAMPLE 10

A diaphragm of chrysotile asbestos was formed on the cathode using the stages of Example 9. After formation of the diaphragm on the cathode, the diaphragm was treated, on the cathode, with a solution of 40G of alcohol per liter, then the cathode furnished with the diaphragm was set up in the cell with the separation between the anode and the cathode set at 5 mm. At the end of the test (20 days), a voltage of 3.09V was recorded at the cell terminals and the permeability of the diaphragm was found to be $0.126h^{-1}$.

EXAMPLE 11

An asbestos diaphragm was formed on the foraminate cathode of the cell using the procedure described in Example 9. The diaphragm was then dried on the cathode, by heating it for 16 hours at 90° C., then the cathode furnished with the diaphragm was set up in the electrolyte cell, the anode-cathode distance being adjusted to 5 mm.

At the end of an electrolysis test of 20 days, the voltage at the cell terminals was found to be 3.12V and the permeability of the diaphragm had settled down at $0.113^{-1}$.

EXAMPLE 12

A diaphragm was formed on the foraminate cathode of the cell using the stages of the procedure described in Example 8, then the diaphragm was dried by heating it on the cathode for 16 hours at 90° C. After 20 days of electrolysis the voltage measured at the cell terminals was 3.10V and the diaphragm showed a permeability $K = 0.138h^{-1}$. After 75 days of electrolysis the measured voltage was still 3.10V and the diaphragm showed a permeability $K = 0.120h^{-1}$.

EXAMPLE 13

The test of Example 12 was repeated, but this time using an aqueous solution containing 40g of alcohol per liter and no phosphate for preparing the diaphragm. the suspension of asbestors thus obtained had an absolute viscosity of about 22 centipoises at 20° C.

At the end of a period of electrolysis of 20 days, a voltage of 3.01V was recorded at the cell terminals and the diaphragm had a permeability of $0.116h^{-1}$.

EXAMPLE 14

The test of Example 12 was repeated, but this time using for preparation of the diaphragm an aqueous solution free from phosphate and containing 100g of polyvinyl alcohol sold under the trade mark ELVANOL 70/05 per liter. The absolute viscosity of the asbestos suspension has risen to 27 centipoises at 20° C. After an electrolysis trial of 10 days a voltage of 3.01V was recorded, while the diaphragm had a permeability of $0.123h^{-1}$.

EXAMPLE 15

17.5g of chrysotile asbestos were dispersed in 0.9 liter of an aqueous solution containing 12g of polyvinyl alcohol sold under the trade mark POLYVIOL W 25/140 per liter and free from phosphate. After homogenizing the suspension (having an absolute viscosity of 2.5 centipoises at 20° C.) a diaphragm was formed from this suspension on the cathode, using the procedure described in Example 1.The diaphragm thus obtained was then treated with 0.5 liter of an aqueous solution containing 40g of alcohol W25/140 per liter, then dried by heating it at 90° C. for 1 hour. After an electrolysis test of 20 days, there were recorded an electrolyzing voltage of 3.02V and a permeability of the diaphragm equal to $0.131h^{-1}$.

EXAMPLE 16

17.5g of chrysotile asbestos were dispersed in 0.9 liter of an aqueous solution free from phosphate and containing 40g of sodium polyhydroxyacrylate per liter. A diaphragm was formed on the foraminate cathode from this suspension, using the stages of the procedure described in Example 1, then the diaphragm was dried by heating it on the cathode at 90° C. for 1 hour. After an electrolysis test of 20 days, the voltage measured at the cell terminals was 3.04V and the diaphragm had a permeability $K = 1.160h^{-1}$.

The results of the second series of tests, according to the invention, are recorded in Table 2.

A comparison of Tables 1 and 2 demonstrates the beneficial effect of the method according to the invention on the electrolyzing voltage and on the permeability of the diaphragm.

We claim:

1. Pervious diaphragms for cells for the electrolysis of aqueous solutions of alkali metal halides comprising inorganic fibers and a polymer dispersed throughout the inorganic fibrous mass, wherein the polymer is selected from water soluble polyelectrolytes insoluble in said aqueous solutions of alkali metal halides.

2. Diaphragms according to claim 1, wherein the polymer is selected from the polyacids.

3. Diaphragms according to claim 2, wherein the polyacids are derivatives of polymers containing at least one hydroxyl group per ten carbon atoms.

4. Diaphragms according to claim 3, wherein the polymer is selected from polyacrylic acids, polymethacrylic acids, copolymers of maleic acid, carboxylic derivatives of cellulosic ethers, sulphonic and phosphonic polymers, and their alkali metal salts.

5. Diaphragms according to claim 1, wherein the polymer is a polyvinyl alcohol.

6. Diaphragms according to claim 5, wherein the polyvinyl alcohol has a degree of hydrolysis higher than 80 moles % and a degree of polymerization higher than 500.

7. Diaphragms according to claim 6, wherein the polyvinyl alcohol has a degree of hydrolysis between 85 and 95 moles % and a degree of polymerization between 1500 and 2500.

8. Diaphragms according claim 1 wherein the polymer is a polymer comprising monomeric units of formula:

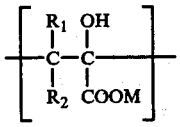

where $R_1$ and $R_2$ represent hydrogen or an alkyl group containing 1 to 3 carbon atoms and where M represents

TABLE 2

| Test No | Solution of Asbestos (s.a.) suspension | Solution of Polymer | Drying | Electrolysis: Anode-Cathode Distance (mm) | Electrolysis: Duration (days) | Voltage (V) | Permeability $K(h^{-1})$ |
|---|---|---|---|---|---|---|---|
| 7 | Solution NaCl + NaOH | Solution of 40g/l Polyviol | 16 hrs 90° C | 5 | 20 | 3.18 | 0.114 |
| 8 | Elvanol 52/22 (12g/l) + $NaH_2PO_4$ (2 g/l) | Solution s.a. | None | 5 | 20 | 3.15 | 0.127 |
| | | | | | 40 | 3.13 | 0.178 |
| 9 | Elvanol 52/22 (12g/l) | Solution s.a. | None | 5 | 20 | 3.15 | 0.139 |
| 10 | idem | Solution s.a. + Elvanol 52/22(40g/l) | None | 5 | 20 | 3.09 | 0.126 |
| 11 | idem | Solution s.a. | 16 hrs at 90° C | 5 | 20 | 3.12 | 0.113 |
| 12 | Elvanol 52/22 (12g/l) + $NaH_2PO_4$ (2g/l) | Solution s.a. | idem | 5 | 20 | 3.10 | 0.138 |
| | | | | | 75 | 3.10 | 0.120 |
| 13 | Elvanol 52/22 (40g/l) | Solution s.a. | idem | 5 | 20 | 3.01 | 0.116 |
| 14 | Elvanol 70/05 (100g/l) | Solution s.a. | idem | 5 | 10 | 3.01 | 0.123 |
| 15 | Polyviol W25/140 (12g/l) | Solution s.a. + Polyviol W25/140 (40g/l) | idem | 5 | 20 | 3.02 | 0.131 |
| 16 | Sodium polyhydroxy acrylate (40g/l) | Solution s.a. | idem | 5 | 20 | 3.04 | 0.160 |

hydrogen, an alkali metal atom or an ammonium group.

9. Diphragms according to claim 8, wherein $R_1$ and $R_2$ represent hydrogen and M represents a sodium atom.

10. Diaphragms according to claim 1 wherein the polymer has a solubility of less than 1% at 20° C. in aqueous solutions containing 250 g/l. of sodium chloride.

11. Diaphragms according to claim 1 containing more than 10g of said polyelectrolyte per kg of inorganic fibres.

12. Diaphragms according to claim 1 wherein said inorganic fibres are fibers of chrysotile asbestos.

13. A method for the manufacture of diaphragms according to claim 1 wherein said inorganic fibers are impregnated with a solution of the polyelectrolyte.

14. The method according to claim 13 wherein said inorganic fibers, formed into a coherent sheet are washed with the solution of polyelectrolyte.

15. The method according to claim 13 wherein said inorganic fibers of asbestos are dispersed in the solution of polyelectrolyte, then the suspension thereby obtained is aspirated through a foraminate support.

16. The method according to claim 15, wherein the foraminate support consists of a foraminate metal cathode of an electrolytic cell.

17. The method according to claim 13 wherein after the inorganic fibres have been impregnated with the solution of polyelectrolyte, the diaphragm is dried at least partially at a temperature below the melting point of the polyelectrolyte.

18. The method according to claim 17, wherein in order to dry the diaphragm, it is heated to a temperature lower than the boiling point of the solvent of the solution of polyelectrolyte.

19. The method according to claim 13 wherein after the inorganic fibers have been impregnated with the solution of polymer, the diaphragm is treated with a liquor in which the polyelectrolyte is insoluble.

20. The method according to claim 13 wherein the solution of polyelectrolyte is an aqueous solution.

21. The method according to claim 20 wherein a phosphate of ammonium or of an alkali metal is dissolved in the aqueous solution.

22. The method according to claim 15, wherein the absolute viscosity of the suspension of asbestos is adjusted so as to be between 1 and 30 centipoises at 20° C.

23. The method according to claim 22 wherein the absolute viscosity is between 2 and 10 centipoises at 20° C.

24. Diaphragm cells for the electrolysis of aqueous solutions of alkali metal halides wherein the cells are equipped with a diaphragm according to claim 1.

25. Diaphragm cells for the electrolysis of aqueous solutions of alkali metal halides wherein the cells are equipped with a diaphragm manufactured in accordance with the method of claim 13.

* * * * *